US009888759B2

(12) United States Patent
Asako

(10) Patent No.: US 9,888,759 B2
(45) Date of Patent: Feb. 13, 2018

(54) DRAWING DEVICE AND METHOD OF DRAWING

(71) Applicant: CASIO COMPUTER CO., LTD., Tokyo (JP)

(72) Inventor: Kenichiro Asako, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/252,530

(22) Filed: Aug. 31, 2016

(65) Prior Publication Data

US 2017/0079405 A1 Mar. 23, 2017

(30) Foreign Application Priority Data

Sep. 17, 2015 (JP) ..... 2015-183512

(51) Int. Cl.

| | |
|---|---|
| ***G06K 15/22*** | (2006.01) |
| ***A45D 34/04*** | (2006.01) |
| ***A45D 29/00*** | (2006.01) |
| *A45D 34/00* | (2006.01) |

(52) U.S. Cl.

CPC ..... *A45D 34/041* (2013.01); *A45D 29/00* (2013.01); *A45D 2029/005* (2013.01); *A45D 2034/002* (2013.01)

(58) Field of Classification Search

CPC ..... G06F 3/13; G06K 15/22

See application file for complete search history.

(56) References Cited

U.S. PATENT DOCUMENTS

| | | | | |
|---|---|---|---|---|
| 5,757,395 | A * | 5/1998 | Chew | B41J 2/16511 347/24 |
| 5,876,140 | A * | 3/1999 | Kuramoto | A45D 34/042 215/295 |
| 6,525,724 | B1 | 2/2003 | Takami | |
| 9,637,269 | B1 * | 5/2017 | Zabaleta | A61J 9/00 |
| 2003/0152410 | A1 * | 8/2003 | Huang | A45D 40/24 401/19 |
| 2008/0238996 | A1 * | 10/2008 | Takada | B26F 1/3806 347/37 |

(Continued)

FOREIGN PATENT DOCUMENTS

| | | |
|---|---|---|
| JP | H6-79592 U | 11/1994 |
| JP | H8-2710 B2 | 1/1996 |

(Continued)

*Primary Examiner* — Ted Barnes

(74) *Attorney, Agent, or Firm* — Chen Yoshimura LLP

(57) ABSTRACT

A drawing device includes a pen that applies a liquid material to a drawing surface and a cap that covers a tip side of the pen and is arranged at a standby position of the pen. The cap includes: an inner cap that has an opening and covers the tip side of the pen when a periphery of the opening is brought into contact with the outer peripheral surface of the tip side of the pen; an outer cap that has an opening, is arranged outside of the inner cap, and covers the tip side of the pen that is covered by the inner cap when the pen is locked into the outer cap; and an elastic member that is arranged between the outer cap and the inner cap and energizes the inner cap towards an opening side of the outer cap. The pen and the outer cap each have an interlockable locking mechanism.

11 Claims, 8 Drawing Sheets

(56) References Cited

U.S. PATENT DOCUMENTS

| | | | | |
|---|---|---|---|---|
| 2013/0223916 | A1* | 8/2013 | Lira-Nunez | B43K 23/12 401/202 |
| 2014/0060560 | A1* | 3/2014 | Bitoh | A45D 29/00 132/73 |
| 2014/0063084 | A1* | 3/2014 | Yamasaki | B41J 3/407 347/3 |
| 2015/0027480 | A1* | 1/2015 | Bitoh | A45D 29/00 132/200 |

FOREIGN PATENT DOCUMENTS

| | | | |
|---|---|---|---|
| JP | 2000-194838 | A | 7/2000 |
| JP | 2015-023981 | A | 2/2015 |

* cited by examiner

DRAWING DEVICE AND METHOD OF DRAWING

BACKGROUND OF THE INVENTION

1. Field of the Invention

The present invention relates to a cap mechanism, a drawing device, and a method of drawing.

2. Description of the Related Art

Various technologies have been developed for use in conventional drawing devices for drawing nail designs on fingernails.

Japanese Patent Application Laid-Open Publication No. 2000-194838 discloses a nail art device for drawing nail designs on the fingernails that includes a holder for locking the finger in place.

This nail art device utilizes an inkjet printer to print nail designs on the fingernails.

In this type of device, using a pen plotter or the like makes it possible to draw using inks that contain glitter, which have a large particle size and are difficult to use as inkjet inks. However, in consideration of safety of use on the human body, it is preferable that any inks filled into the liquid material applicator (pen) used in a pen plotter be water-soluble. With these types of inks, if the tip of the pen is not covered when the pen is not in use, the ink on the tip of the pen tends to dry and quickly render the pen unusable.

In conventional pens, pushing a cap onto the pen with a force of approximately 2 kgf attaches the cap to the pen in a locked state sufficient to prevent drying of the pen tip.

However, to avoid an increase in the overall size of the device, the motors used in the mechanism that moves the pen must be small. This makes it difficult to press a cap onto the pen with sufficient force.

To solve this problem, the device configuration illustrated in FIGS. 6A and 6B includes a cap 100 that can house a pen tip 33 of a pen 30. As illustrated in FIG. 6A, when the pen 30 is not in use, the pen 30 is moved to the cap 100. Then, as illustrated in FIG. 6B, the pen 30 is simply placed on the cap 100 to insert the pen tip 33 into the cap 100.

In this case, although the pen tip 33 is covered by the cap 100, the pen 30 is simply resting on the cap 100 under the weight of the pen 30 itself. Therefore, the strength of the resulting seal is poor, and only a limited anti-drying effect is achieved.

The present invention was made in view of the above-mentioned problems and aims to provide a cap mechanism, a drawing device, and a method of drawing that make it possible to achieve an exceptional anti-drying effect for the pen tip while minimizing any increases in the overall size of the device.

SUMMARY OF THE INVENTION

In order to solve the problems described above, the present invention provides a cap mechanism, a drawing device, and a method of drawing.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a drawing device, including: a liquid material applicator that applies a liquid material to at least one portion of a surface of a nail; and a cap that covers a tip side of the liquid material applicator, wherein the cap includes: an inner cap that has an opening and, when an edge of the opening in the inner cap contacts an outer peripheral surface of the tip side of the liquid material applicator, the inner cap houses at least one portion of the tip side of the liquid material applicator; an outer cap that has an opening and that is arranged outside of the inner cap and, when the at least one portion of the tip side of the liquid material applicator is housed in the inner cap, the outer cap houses a region that includes the at least one portion of the tip side of the liquid material applicator that is housed by the inner cap; and an elastic member that is arranged between the outer cap and the inner cap and that applies reaction force to the inner cap towards the opening in the outer cap when another force is added to the inner cap, and wherein the liquid material applicator and the outer cap have a locking mechanism that locks the liquid material applicator and the outer cap together.

In another aspect, the present disclosure provides a method of drawing using a drawing device, including: preparing the drawing device, which includes a liquid material applicator that applies a liquid material to at least one portion of a surface of a nail; and a cap that covers a tip side of the liquid material applicator, the cap including: an inner cap that has an opening and, when an edge of the opening in the inner cap contacts an outer peripheral surface of the tip side of the liquid material applicator, the inner cap houses at least one portion of the tip side of the liquid material applicator; an outer cap that has an opening and that is arranged outside of the inner cap and, when the at least one portion of the tip side of the liquid material applicator is housed in the inner cap, the outer cap houses a region that includes the at least one portion of the tip side of the liquid material applicator that is housed by the inner cap; and an elastic member that is arranged between the outer cap and the inner cap and that applies force to the inner cap towards the opening in the outer cap; contacting the outer peripheral surface of the tip side of the liquid material applicator to the edge of the opening of the inner cap when the liquid material applicator is not applying the liquid material on the surface of the nail; and locking the liquid material applicator to the outer cap via a pressing force that is greater than a pressing force of a contact state with the outer peripheral surface of the tip side of the liquid material applicator and that opposes a force of the elastic member, the pressing force being applied through the liquid material applicator to the edge of the opening in the inner cap, thereby causing the locking mechanism of the liquid material applicator and the outer cap to lock the liquid material applicator and the outer cap together.

In another aspect, the present disclosure provides a cap mechanism, including: at least one liquid material applicator that applies a liquid material to at least one portion of a surface of a nail; and at least one cap that covers a tip side of the liquid material applicator, wherein the cap includes: an inner cap that has an opening and, when an edge of the opening in the inner cap contacts an outer peripheral surface of the tip side of the liquid material applicator, the inner cap houses at least one portion of the tip side of the liquid material applicator; an outer cap that has an opening and that is arranged outside of the inner cap and, when the at least one portion of the tip side of the liquid material applicator is housed in the inner cap, the outer cap houses a region that includes the at least one portion of the tip side of the liquid material applicator that is housed by the inner cap; and an elastic member that is arranged between the outer cap and the inner cap and that applies reaction force to the inner cap towards the opening in the outer cap when another force is added to the inner cap, and wherein the liquid material applicator and the outer cap have a locking mechanism that locks the liquid material applicator and the outer cap together.

The present invention makes it possible to provide a cap mechanism, a drawing device, and a method of drawing that exhibit an exceptional anti-drying effect for the pen tip while minimizing any increases in the overall size of the device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter. It is to be understood that both the foregoing general description and the following detailed description are exemplary and explanatory, and are intended to provide further explanation of the invention as claimed.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF EMBODIMENTS

Figure 1:
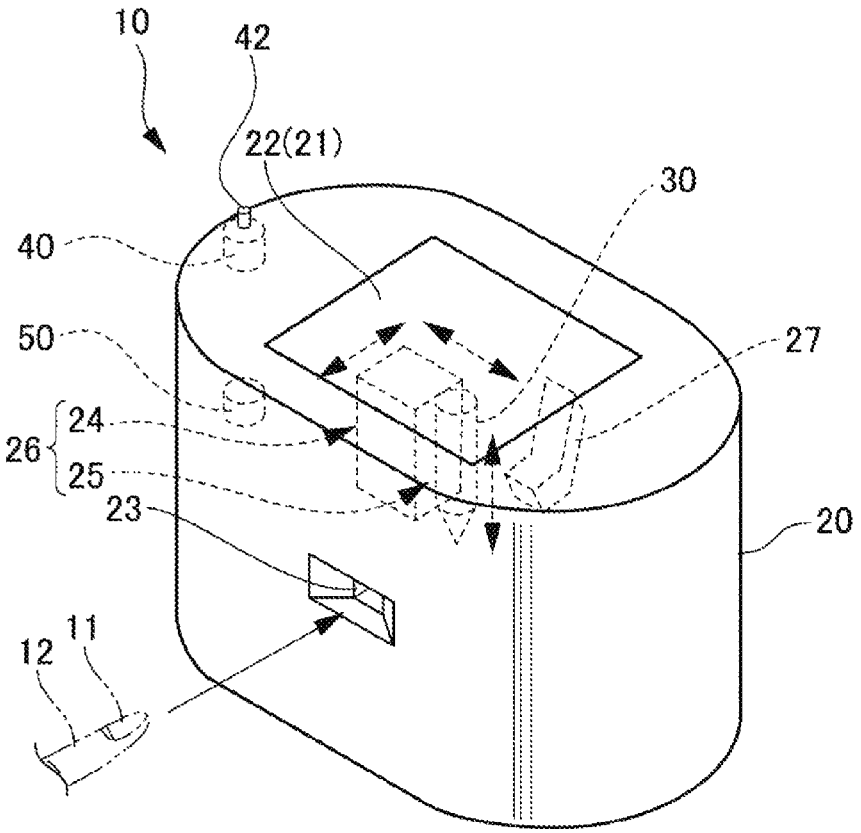
FIG. 1 schematically illustrates a drawing device according to Embodiment 1 of the present invention.

Next, embodiments of the present invention will be described in detail with reference to the attached figures. In the figures and the following description, the same reference characters are used for components that are the same in each embodiment.

Moreover, the following description of the embodiments assumes that the drawing device of the present invention is used to draw on the fingernails. However, the present invention is not limited to this use case and may also be used to draw on the toenails, for example.

Embodiment 1

FIG. 1 schematically illustrates a drawing device according to Embodiment 1 of the present invention.

As illustrated in FIG. 1, a drawing device 10 is a device for drawing a nail design on the surface (the drawing surface) of a nail 11 of a finger 12, for example.

The drawing device 10 includes a case 20 and a touch panel-type display unit 22 that also functions as an operation unit 21 and that is provided on the top surface of the case 20.

Furthermore, a finger opening 23 is formed in the front surface of the case 20.

Inside the case 20, a drawing unit 26 that includes an inkjet 24 and a drawing head 25 (such as a pen plotter that uses a liquid material applicator (pen) 30) and a dryer 27 that blows warm air to dry the ink applied to the nail 11 are arranged.

Moreover, inside the case 20, a cap 50 that can cover the tip of the liquid material applicator (pen) 30 is arranged at a standby position to which the pen 30 is moved when not in use. A click member 40 is arranged above the cap 50, with at least a clicking portion 42 going through the top surface of the case 20 and protruding outside of the case 20. These components will be described in more detail later.

In other words, as illustrated in FIG. 1, the position at which the cap 50 is arranged corresponds to the pen standby position, and the cap 50 and the click member 40 are arranged at that position.

The present embodiment includes a single pen 30. However, the present embodiment is not limited to this example and may include a plurality of pens 30.

In a configuration that includes a plurality of the pens 30, a plurality of the caps 50 may be respectively arranged at the corresponding standby positions to which each pen is moved when not in use, and a plurality of the click members 40 may be respectively arranged above the caps 50.

As illustrated by the double-headed dashed arrows in FIG. 1, the pen 30, the inkjet 24, and the dryer 27 can be moved forward and backwards, left and right, and up and down as necessary by various movement units (not illustrated in the figure).

Next, the click member 40, the pen 30, and the cap 50 will be described in more detail.

First, the configuration and operation of the click member 40, the pen 30, and the cap 50 will be described briefly, and then the operation of the overall device will be described.

(Click Member)

FIGS. 2A to 2E illustrate an operation sequence of the pen 30 and the click member 40. First, the operation of the click member 40 and the click member 40 will be described.

Figures 2A, 2B, 2C, 2D, 2E:
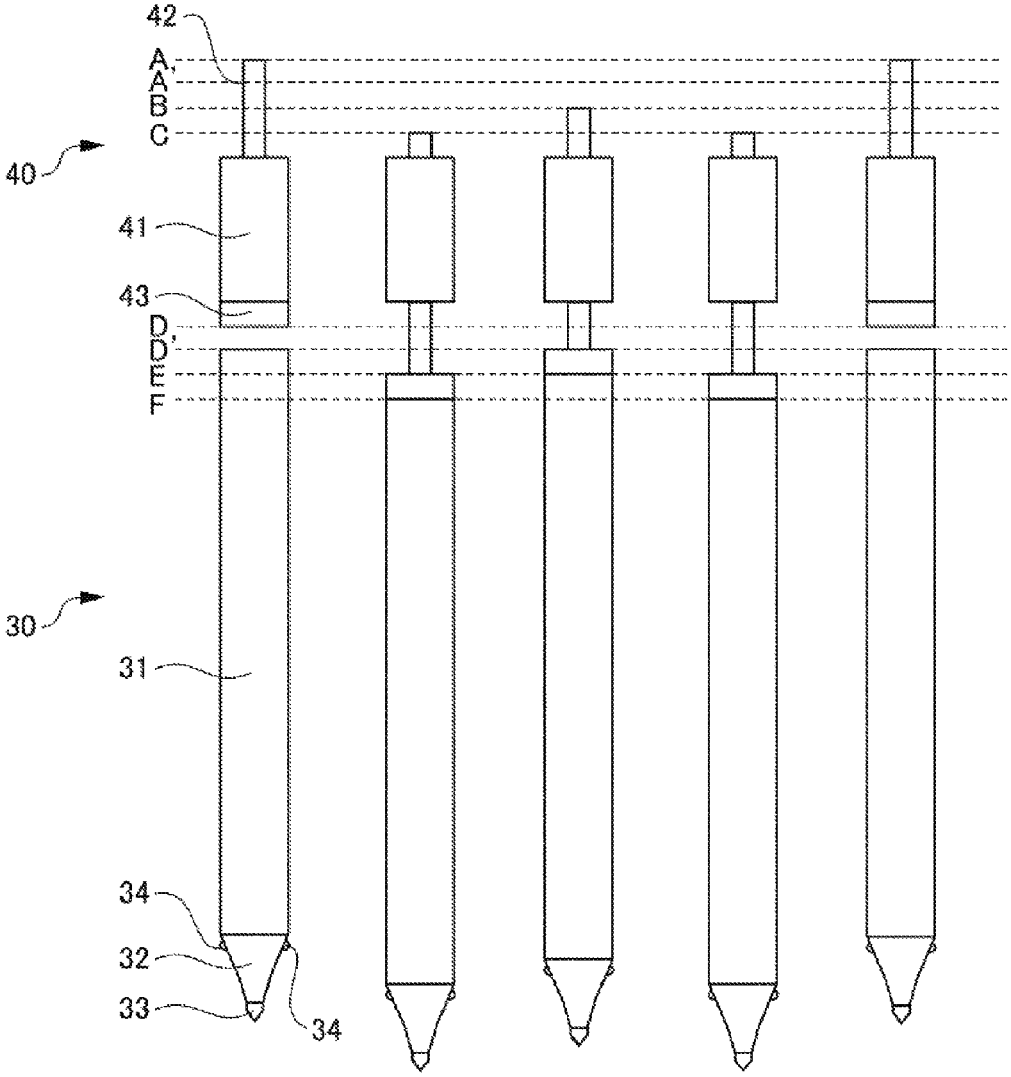
FIGS. 2A to 2E illustrate a pen and a click member according to Embodiment 1 of the present invention.

As illustrated in FIG. 2A, the click member 40 includes a case 41, the clicking portion 42, and a pressing portion 43. Although the internal structure of the click member 40 is not illustrated in the figure, the click member 40 has a structure similar to a rotating cam-type feeding mechanism of the type often used in so-called click-type ballpoint pens and the like.

The click member 40 therefore operates similarly to such conventional click-type ballpoint pens.

More specifically, FIG. 2A illustrates a state in which the clicking portion 42 of the click member 40 has not yet been clicked. Starting from this state, when the clicking portion 42 is clicked, the top end of the click member 40 moves from position A as illustrated in FIG. 2A to position C as illustrated in FIG. 2B.

Here, like in conventional ballpoint pens, the pressing portion 43 of the click member 40 undergoes the same motion as the clicking portion 42. More specifically, the bottom end of the pressing portion 43 that faces the rear end of the pen 30 moves from position D as illustrated in FIG. 2A to position F as illustrated in FIG. 2B.

Once clicking of the clicking portion 42 of the click member 40 is complete, the top end of the clicking portion 42 moves from position C in FIG. 2B to position B as illustrated in FIG. 2C and stops at this position rather than returning to the pre-clicking position A in FIG. 2A.

Again, the pressing portion 43 of the click member 40 undergoes the same motion as the clicking portion 42. More specifically, the bottom end of the pressing portion 43 that faces the rear end of the pen 30 moves from position F in FIG. 2B to position E as illustrated in FIG. 2C and stops at this position.

Note that in the following description, position E (the position at which the pressing portion 43 stops) will be referred to as a "first stop position."

In simpler terms, the operation illustrated in FIGS. 2A to 2C corresponds to an operation in a conventional ballpoint pen in which the button of the ballpoint pen is clicked once, thereby partially hiding the button inside the pen case and causing the pen tip to protrude out from the pen case.

Next, when the clicking portion 42 of the click member 40 is clicked again, the top end of the click member 40 moves from position B in FIG. 2C to position C as illustrated in FIG. 2D.

Once again, the pressing portion 43 of the click member 40 undergoes the same motion as the clicking portion 42. More specifically, the bottom end of the pressing portion 43 that faces the rear end of the pen 30 moves from position E in FIG. 2C (the first stop position) to position F as illustrated in FIG. 2D.

Here, once clicking of the clicking portion 42 of the click member 40 is complete, the top end of the clicking portion 42 moves from position C in FIG. 2D to position A as illustrated in FIG. 2E and stops at this position.

In other words, the second clicking of the click member 40 returns the click member 40 to the state prior to the first clicking illustrated in FIG. 2A.

Again, the pressing portion 43 of the click member 40 undergoes the same motion as the clicking portion 42. More specifically, the bottom end of the pressing portion 43 that faces the rear end of the pen 30 moves from position F in FIG. 2D to position D as illustrated in FIG. 2E and stops at this position.

In the following description, position D (the position at which the pressing portion 43 stops) will be referred to as a "second stop position."

In simpler terms, the operation illustrated in FIGS. 2C to 2E corresponds to an operation in a conventional ballpoint pen in which the button of the ballpoint pen is clicked once in a state in which the pen tip is already stopped at the position protruding out from the pen case, thereby causing the pen tip to return from the position outside of the pen case to the position inside the pen case and stop at that position.

The clicking portion 42 of the present embodiment is only different from the mechanism of a conventional ballpoint pen in that the clicking portion 42 does not include a pen case that houses the pen tip, and therefore the pressing portion 43 is not housed inside the clicking portion 42. However, the basic operation of the clicking portion 42 is the same as the operation of a conventional ballpoint pen.

Furthermore, after clicking the click member 40 twice, clicking the click member 40 again (for the third time) would result in the same behavior as the first clicking.

In this way, the bottom end of the click member 40 that faces the rear end of the pen 30 alternates back and forth between the first stop position (position E) and the second stop position (position D) each time the click member 40 is clicked.

(Pen)

As illustrated in FIG. 2A, the pen 30 includes a cylindrical case 31, a tapered pen end 32 that is formed on the end of the case 31 and becomes smaller in outer diameter moving towards a pen tip side, and a pen tip 33 that protrudes out in the pen tip direction from the end of the pen end 32. In the present embodiment, the pen 30 is filled with a high-volatility water-soluble ink. However, the ink is not limited to this example and may be an ink made from any liquid material, such as a gel.

Furthermore, as illustrated in FIG. 2A, a locking protrusion 34 for locking the cap 50 (see FIG. 1) onto the pen 30 is formed on a tip-side portion of the outer peripheral surface of the pen 30 (this will be described in more detail later).

More specifically, the locking protrusion 34 is a ring-shaped protrusion that is formed around the entire periphery of a case 31-side portion of the outer peripheral surface of the pen end 32 and protrudes out away from that surface.

When the pen 30 is placed on top of the cap 50 (see FIG. 1), an energizing force that acts towards the click member 40 side is applied to the pen 30. When the pressing portion 43 of the click member 40 is not applying any pressure to the pen 30 or the pen 30 is not locked into the cap 50, the rear end of the pen 30 is positioned at position D' as illustrated in FIG. 2A. This will be described in more detail later.

As described above, when the click member 40 is clicked (the first time and the second time), the pressing portion 43 of the click member 40 applies a force to the rear end of the pen 30, thereby causing the pen 30 to move as illustrated in FIGS. 2A to 2E.

More specifically, as illustrated in FIG. 2A, when the clicking portion 42 of the click member 40 is clicked for the first time, the pressing portion 43 which is currently separated from the rear end of the pen 30 moves towards the rear end of the pen 30. Once the top end of the clicking portion 42 reaches position A', the bottom end of the pressing portion 43 reaches position D', thereby bringing the bottom end of the pressing portion 43 into contact with the rear end of the pen 30.

As the top end of the clicking portion 42 then proceeds to move to position C as illustrated in FIG. 2B, the bottom end of the pressing portion 43 moves to position F, thereby applying a force to the rear end of the pen 30. This force opposes the energizing force that acts towards the click member 40 and moves the rear end of the pen 30 to position F.

Then, as the clicking of the click member 40 is completed and the bottom end of the pressing portion 43 returns to and stops at position E (the first stop position) as illustrated in FIGS. 2B and 2C, the pen 30 that is energized towards the click member 40 side also moves such that the rear end of the pen 30 stops at position E.

As illustrated in FIGS. 2C and 2D, when the clicking portion 42 of the click member 40 is clicked again (for the second time), the bottom end of the pressing portion 43 moves from position E (the first stop position) to position F, and the rear end of the pen 30 also moves from position E to position F. Then, as illustrated in FIGS. 2D and 2E, once the clicking is complete, the bottom end of the pressing portion 43 moves from position F to position D (the second stop position), and the pen 30 also moves towards position D. However, the rear end of the pen 30 stops at position D', which is the furthest the pen 30 can move towards position D. This returns the device to the state illustrated in FIG. 2A, in which the bottom end of the pressing portion 43 is separated from the rear end of the pen 30.

(Cap)

FIGS. 3A to 3E illustrate an operation sequence of the pen 30 and the cap 50. First, the configuration of the cap 50 will be described. Then, the overall operation of the pen 30, the click member 40, and the cap 50 will be described including the operation of the pen 30 and the click member 40 as described above.

Figure 3A:
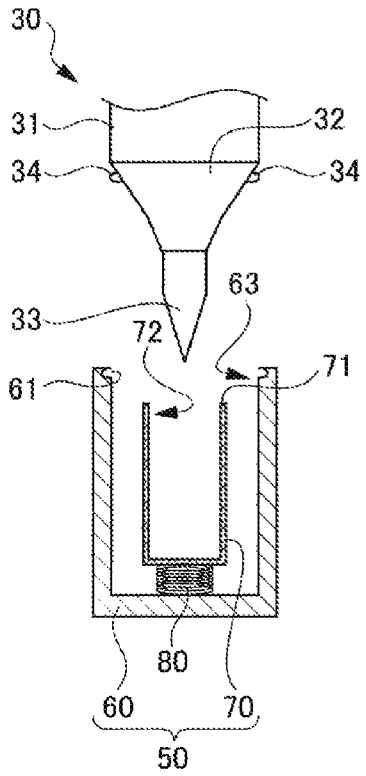
FIGS. 3A to 3E illustrate interlockable locking structures formed on the pen and a cap according to Embodiment 1 of the present invention.

As illustrated in FIG. 3A, the cap 50 includes: an outer cap 60 that has a bottom; an elastic member 80 constituted by a coil spring and arranged inside the outer cap 60; and an inner cap 70 that is arranged inside the outer cap 60, has an opening 72 and a bottom, and is energized towards an opening 63 side of the outer cap 60 by the elastic member 80.

Furthermore, a locking recess 61 for locking together with the locking protrusion 34 formed on the pen 30 is formed on the inner peripheral surface of the outer cap 60.

More specifically, the locking recess 61 is a ring-shaped recess that is formed around the entire periphery of an opening 63-side portion of the inner peripheral surface of the outer cap 60 and recedes towards the outer peripheral surface thereof.

Note that the relationship between the locking protrusion 34 formed on the pen 30 and the locking recess 61 formed in the outer cap 60 may be reversed.

In other words, a locking protrusion may be formed on the inner peripheral surface of the outer cap 60, and a locking recess that locks together with that locking protrusion may be formed in a tip-side portion of the outer peripheral surface of the pen 30.

Furthermore, as described above in reference to FIG. 1, the cap 50 is arranged at a standby position to which the pen 30 is moved when not being used to draw.

Next, the operation of the device when a nail design is completed and the device is turned off will be described using FIGS. 3A to 3E.

FIG. 3A illustrates a state in which a nail design has just been completed, and a movement unit (not illustrated in the figure) has moved the pen 30 to the cap 50.

Figure 3B:
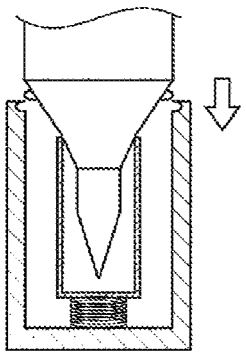

As illustrated in FIG. 3B, after moving the pen 30 to the cap 50, the movement unit (not illustrated in the figure) places the pen 30 on top of the cap 50.

The state illustrated in FIG. 3B in which the pen 30 has been placed on the cap 50 corresponds to the state illustrated in FIG. 2A.

Note that the gap between the rear end of the pen 30 and the bottom end of the pressing portion 43 in FIG. 2A (that is, the distance between position D and position D') is not drawn to scale. In reality, this distance is simply set to a value that makes it possible to perform the operation illustrated in FIGS. 3A and 3B on the pen 30.

As illustrated in FIG. 3B, the inner cap 70 is energized towards the opening 63 side of the outer cap 60 by the elastic member 80 and is arranged within the outer cap 60 such that when the pen 30 is placed on top of the cap 50, an opening periphery 71 of the inner cap 70 (see FIG. 3A) contacts the outer peripheral surface on the tip side of the pen 30 (that is, the outer peripheral surface of the pen end 32).

Therefore, the pen tip 33 is moderately sealed by the inner cap 70 when the pen 30 is placed on top of the cap 50, thereby preventing drying of the pen tip 33. However, in this state drying cannot be prevented over the long term because the seal is not particularly strong.

Using the inner cap 70 to create a moderate seal around the pen tip 33 when the pen 30 is placed on top of the cap 50 makes it possible to prevent drying of the pen tip 33 during formation of a nail design by temporarily placing the pen 30 on top of the cap 50 while using the inkjet 24 (see FIG. 1) to print the nail design, for example.

When the user clicks the clicking portion 42 of the click member 40 (which protrudes out through the top surface of the case 20 as illustrated in FIG. 1), the bottom end of the pressing portion 43 stops at position E (the first stop position, see FIG. 2C) as described above using FIGS. 2A to 2C. This causes the pen 30 to stop in a state in which the locking protrusion 34 of the pen 30 is locked into the locking recess 61 of the outer cap 60.

Figure 3C:
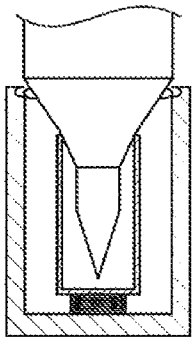

In FIG. 3B, the pen 30 is simply placed on top of the cap 50. In FIG. 3C, the pen 30 is locked in place by the locking structure constituted by the locking protrusion 34 of the pen 30 and the locking recess 61 of the outer cap 60. In the latter case in which the pen 30 is locked in place by the locking structure, the pen 30 is positioned closer to the bottom side of the outer cap 60, thereby compressing the elastic member 80.

When the pen 30 is locked in place by the locking structure, the inner cap 70 is strongly pressed into the outer peripheral surface on the tip side of the pen 30 (that is, the outer peripheral surface of the pen end 32), thereby increasing the strength of the seal and making it possible to prevent drying of the pen tip 33 for a long period of time.

Using the locking structure to lock the pen 30 in place after a nail design is completed prevents drying of the pen tip 33 of the pen 30 while the drawing device 10 is not in use.

In the present embodiment, the pressing portion 43 of the click member 40 can also function as a locking structure. Therefore, the locking protrusion 34 of the pen 30 and the locking recess 61 of the outer cap 60 may be removed, and the click member 41 itself may function as the locking structure.

However, forming the locking protrusion 34 on the pen 30 and the locking recess 61 on the outer cap 60 makes it possible to stably lock the pen 30 in place even when there is instability or the like in the clicking mechanism of the click member 40.

The next time the drawing device 10 is used, the user simply clicks the clicking portion 42 of the click member 40 again to perform the operation described above as the second clicking.

More specifically, this corresponds to clicking the clicking portion 42 of the click member 40 starting from the state illustrated in FIG. 2C.

As illustrated in FIG. 2D, this temporarily moves the bottom end of the pressing portion 43 from the first stop position (position E) in FIG. 2C to position F, which is located further towards the pen tip 33 side of the pen 30.

Figure 3D:
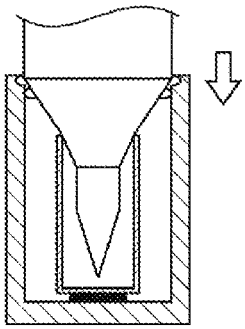

FIGS. 3C and 3D illustrate the corresponding behavior of the pen tip 33 and the cap 50 during this operation.

As illustrated in FIG. 3D, as the pressing portion 43 temporarily moves from the first stop position (position E if FIG. 2C) to a position closer to the bottom surface side of the outer cap 60, the elastic member 80 is strongly compressed.

Figure 3E:
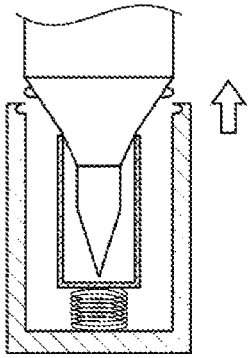

As illustrated in FIGS. 2D and 2E, once the clicking of the click member 40 is complete, the bottom end of the pressing portion 43 moves to the second stop position (position D), which is separated from the rear end of the pen 30. As illustrated in FIGS. 3D and 3E, this releases the elastic member 80 from the compressed state and allows the elastic member 80 to extend energetically.

The energizing force of the elastic member 80 frees the locking structure constituted by the locking protrusion 34 of the pen 30 and the locking recess 61 of the outer cap 60 from the locked state. This returns the pen 30 to the state in which the pen 30 is simply resting on top of the cap 50 and from which the movement unit (not illustrated in the figure) can move the pen 30 as necessary.

In Embodiment 1, the user clicks the clicking portion 42 of the click member 40 before and after using the drawing device 10. However, the present invention is not limited to the embodiment described above. In other words, in situations in which it does not matter if the device increases in size or a small motor that does not increase the size of the device can be used, the clicking portion 42 of the click member 40 may be clicked using a motor arranged within the device.

(Modification Example of Click Member)

The description above assumes use of a single pen 30. However, as mentioned earlier, the number of pens 30 included in the drawing device 10 is not particularly limited.

In configurations that include a plurality of the pens 30, a corresponding number of caps 50 and click members 40 may be provided. Alternatively, the configuration illustrated in FIG. 4 may be used for the click member 40. This configuration makes it possible to increase the number of pens 30 without having to increase the number of click members 40.

Figure 4:
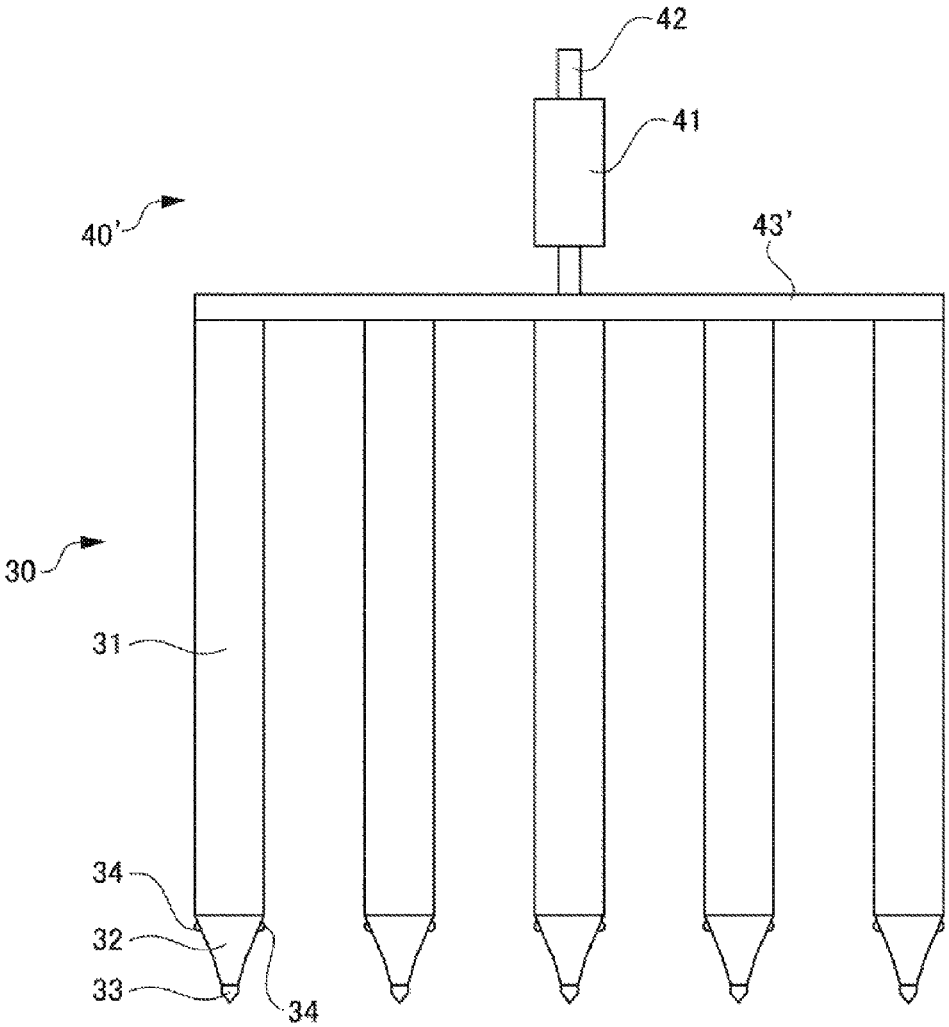
FIG. 4 illustrates a modification example of the click member according to Embodiment 1 of the present invention.

More specifically, as illustrated in FIG. 4, in a click member 40' according to a modification example, the area or width of the pressing portion 43 of the click member 40 is increased to form a pressing portion 43' that can apply pressure to the rear ends of a plurality of the pens 30 at the same time. The click member 40' is otherwise identical to the click member 40.

This makes it possible to provide a click member 40' that supports use of a plurality of the pens 30 simply by changing the shape of the pressing portion 43 of the click member 40.

Embodiment 2

Next, Embodiment 2 of the present invention will be described.

The basic configuration of Embodiment 2 is the same as Embodiment 1. Therefore, the following description omits the aspects of Embodiment 2 that are the same as in Embodiment 1 and focuses primarily on the aspects that are different.

FIGS. 5A to 5D correspond to the view of Embodiment 1 provided in FIG. 3A to 3E and illustrates a cap 50 and the tip side of a pen 30 according to Embodiment 2.

In Embodiment 2, a male threaded groove 35 is formed on the outer peripheral surface of the tip side of the pen 30 (that is, the outer peripheral surface of a pen end 32) instead of the locking protrusion 34 described in Embodiment 1.

Meanwhile, a female threaded groove 62 is formed on the inner peripheral surface of an opening 63 side of an outer cap 60 instead of the locking recess 61 described in Embodiment 1.

In other words, in Embodiment 2 the locking structure is constituted by threads formed on the outer peripheral surface of the tip side of the pen 30 and on the inner peripheral surface of the outer cap 60.

Figure 5A:
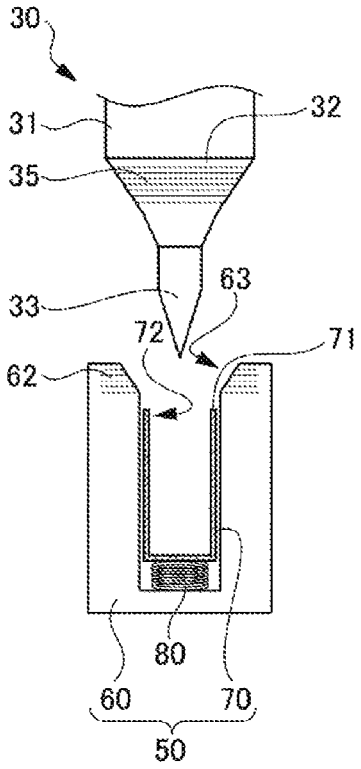
FIGS. 5A to 5D illustrate interlockable locking structures formed on a pen and a cap according to Embodiment 2 of the present invention.
Figure 5B:
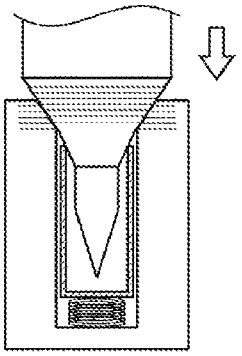
Figure 5C:
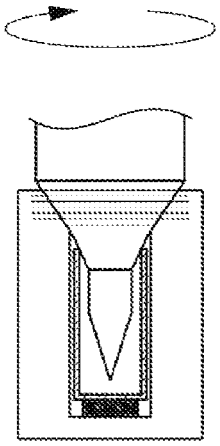

Therefore, after a movement unit (not illustrated in the figure) moves the pen 30 to a position above the cap 50 as illustrated in FIG. 5A, the pen 30 is placed on top of the cap 50 as illustrated in FIG. 5B. Then, as illustrated in FIG. 5C, a rotation mechanism included in the movement unit (not illustrated in the figure) rotates the pen 30 to screw the pen 30 into the threads.

This moves the pen 30 from the state in which the pen 30 is resting on top of the cap 50 to a state in which the pen 30 is closer to the bottom surface side of the outer cap 60, thereby compressing an elastic member 80. The resulting energizing force strongly presses an inner cap 70 into the outer peripheral surface on the tip side of the pen 30 (that is, the outer peripheral surface of the pen end 32), thereby forming a strong seal.

Like in Embodiment 1, this makes it possible to prevent drying of a pen tip 33 for a long period of time.

Figure 5D:
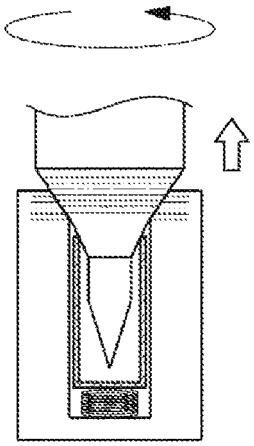
Figure 6A:
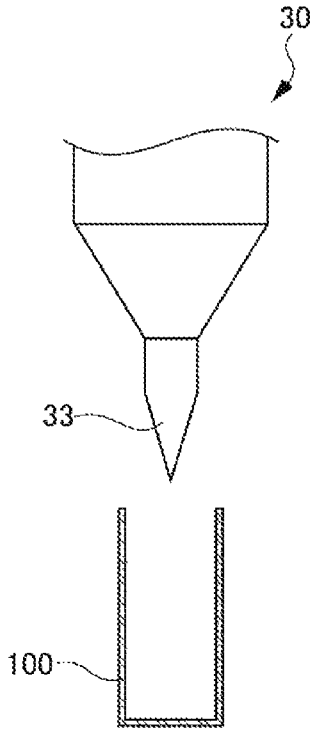
FIGS. 6A and 6B illustrate the configuration of a cap for a pen used in a conventional device.
Figure 6B:
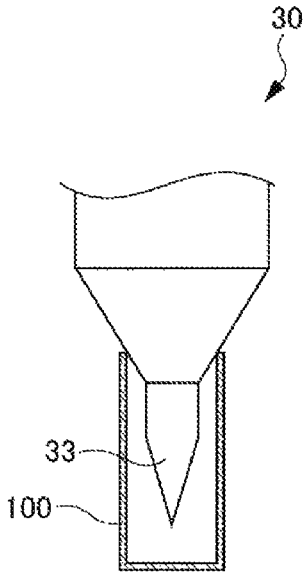

Meanwhile, to deploy the pen 30 for use, the rotation mechanism of the movement unit (not illustrated in the figure) rotates the pen 30 in the opposite direction. As illustrated in FIG. 5D, this unscrews the pen 30 from the threads, thereby returning the pen 30 to the state illustrated in FIG. 5B in which the pen 30 is simply resting on the cap 50 and from which the pen 30 can be moved again as necessary.

In Embodiment 2, the click member 40 of Embodiment 1 is not required. Moreover, the locking structure can be engaged and disengaged simply by rotating the pen 30, which for a motor represents only a small additional movement.

Therefore, a small motor can be included in the device. This makes it possible to avoid any increases in the size of the device while also making it possible to configure the device to automatically engage and disengage the locking structure rather than the user needing to perform this operation.

In Embodiments 1 and 2 as described above, a pen 30 of the type used in a pen plotter is used as the liquid material applicator. However, the present invention is not limited to these embodiments. In other words, the liquid material applicator is not limited to the pen 30 and may be a cover or the like that attaches to the tip (head) of the inkjet 24.

The present invention was described above using specific embodiments as examples. However, the technical scope of the present invention is not limited to the embodiments described above.

It is understood to persons skilled in the art that various modifications or improvements can be made to the specific embodiments described above, and such modifications and improvements are included within the technical scope of the present invention as defined by the claims.

What is claimed is:

1. A drawing device, comprising:

a liquid material applicator that applies a liquid material to at least one portion of a surface of a nail; and a cap that covers a tip side of the liquid material applicator, wherein the cap includes:

an inner cap that has an opening and, when an edge of the opening in said inner cap contacts an outer peripheral surface of the tip side of the liquid material applicator, the inner cap houses at least one portion of the tip side of the liquid material applicator;

an outer cap that has an opening and that is arranged outside of the inner cap and, when said at least one portion of the tip side of the liquid material applicator is housed in the inner cap, the outer cap houses a region that includes said at least one portion of the tip side of the liquid material applicator that is housed by the inner cap; and an elastic member that is arranged between the outer cap and the inner cap and that applies reaction force to the inner cap towards the opening in the outer cap when another force is added to the inner cap, and wherein the liquid material applicator and the outer cap have a locking mechanism that locks the liquid material applicator and the outer cap together, wherein the locking mechanism includes:

at least one outer cap recess or protrusion on an inner peripheral surface of the outer cap; and at least one tip side recess or protrusion on the outer peripheral surface of the tip side of the liquid material applicator, said at least one tip side recess or protrusion being interlockable with said at least one outer cap recess or protrusion on the outer cap, wherein the cap is arranged at a prescribed position inside the drawing device, wherein the drawing device includes:

a click member that, when the cap is disposed at the prescribed position, is arranged so as to be located on a rear end side of the liquid material applicator in a state in which the outer peripheral surface of the tip side of the liquid material applicator is in contact with the edge of the opening of the inner cap, said click member including a clicking portion and a pressing portion that presses a rear end of the liquid material applicator when the clicking portion is clicked, wherein clicking the clicking portion of the click member switches a stopped position of the pressing portion between a first position near the cap and a second position that is further away from the cap than the first position, wherein when the pressing portion moves from the first position to the second position, the pressing portion is temporarily positioned closer to a bottom side of the outer cap than the first position and then moves to the second position, and wherein when the pressing portion moves to the second position, the reaction force from the elastic member being freed from a compressed state unlocks the locking mechanism.

2. The drawing device according to claim 1, wherein the cap is provided in a plurality in accordance with an amount of a plurality of the liquid material applicator at the prescribed location, wherein the pressing portion of the click member has an area that can simultaneously press rear ends of the plurality of the liquid material applicators, and wherein clicking the click member to move the pressing portion between the first position and the second position makes it possible to simultaneously engage and disengage the plurality of the liquid material applicators.

3. The drawing device according to claim 1, further comprising:

a drawing unit including a drawing head that uses the liquid material applicator to draw on the surface of the nail, and an inkjet that draws by printing on the surface of the nail, wherein when the inkjet is printing on the surface of the nail, the liquid material applicator is arranged at a first position in which the outer peripheral surface of the tip side of the liquid material applicator contacts the edge of the opening in the inner cap.

4. A drawing device, comprising:

a liquid material applicator that applies a liquid material to at least one portion of a surface of a nail; and a cap that covers a tip side of the liquid material applicator, wherein the cap includes:

an inner cap that has an opening and, when an edge of the opening in said inner cap contacts an outer peripheral surface of the tip side of the liquid material applicator, the inner cap houses at least one portion of the tip side of the liquid material applicator;

an outer cap that has an opening and that is arranged outside of the inner cap and, when said at least one portion of the tip side of the liquid material applicator is housed in the inner cap, the outer cap houses a region that includes said at least one portion of the tip side of the liquid material applicator that is housed by the inner cap; and an elastic member that is arranged between the outer cap and the inner cap and that applies reaction force to the inner cap towards the opening in the outer cap when another force is added to the inner cap, and wherein the liquid material applicator and the outer cap have a locking mechanism that locks the liquid material applicator and the outer cap together, and wherein the locking mechanism is constituted by a threaded structure disposed between the outer peripheral surface of the tip side of the liquid material applicator and the inner peripheral surface of the outer cap.

5. The drawing device according to claim 4, further comprising:

a drawing unit including a drawing head that uses the liquid material applicator to draw on the surface of the nail, and an inkjet that draws by printing on the surface of the nail, wherein when the inkjet is printing on the surface of the nail, the liquid material applicator is arranged at a first position in which the outer peripheral surface of the tip side of the liquid material applicator contacts the edge of the opening in the inner cap.

6. A method of drawing using a drawing device, comprising:

preparing the drawing device, which includes a liquid material applicator that applies a liquid material to at least one portion of a surface of a nail; and a cap that covers a tip side of the liquid material applicator, said cap including: an inner cap that has an opening and, when an edge of the opening in said inner cap contacts an outer peripheral surface of the tip side of the liquid material applicator, the inner cap houses at least one portion of the tip side of the liquid material applicator; an outer cap that has an opening and that is arranged outside of the inner cap and, when said at least one portion of the tip side of the liquid material applicator is housed in the inner cap, the outer cap houses a region that includes said at least one portion of the tip side of the liquid material applicator that is housed by the inner cap; and an elastic member that is arranged between the outer cap and the inner cap and that applies force to the inner cap towards the opening in the outer cap;

contacting the outer peripheral surface of the tip side of the liquid material applicator to the edge of the opening of the inner cap when the liquid material applicator is not applying the liquid material on the surface of the nail; and locking the liquid material applicator to the outer cap via a pressing force that is greater than a pressing force of a contact state with the outer peripheral surface of the tip side of the liquid material applicator and that opposes a force of the elastic member, said pressing force being applied through the liquid material applicator to the edge of the opening in the inner cap, thereby causing the locking mechanism of the liquid material applicator and the outer cap to lock the liquid material applicator and the outer cap together, wherein the locking mechanism includes:

at least one outer cap recess or protrusion on an inner peripheral surface of the outer cap; and at least one tip side recess or protrusion that is on the outer peripheral surface of the tip side of the liquid material applicator, said at least one tip side recess or protrusion being interlockable with said at least one outer cap recess or protrusion on the outer cap, wherein the cap is arranged at a prescribed position inside the drawing device, wherein the drawing device includes:

a click member that, when the cap is disposed at the prescribed position, is arranged so as to be located on a rear end side of the liquid material applicator in a state in which the outer peripheral surface of the tip side of the liquid material applicator is in contact with the edge of the opening of the inner cap, said click member including a clicking portion and a pressing portion that presses a rear end of the liquid material applicator when the clicking portion is clicked, wherein clicking the clicking portion of the click member switches a stopped position of the pressing portion between a first position near the cap and a second position that is further away from the cap than the first position, wherein when the pressing portion moves from the first position to the second position, the pressing portion is temporarily positioned closer to a bottom side of the outer cap than the first position and then moves to the second position, and wherein when the pressing portion moves to the second position, a force from the elastic member being freed from a compressed state unlocks the locking mechanism.

7. The method of drawing according to claim 6, wherein the cap is provided in a plurality in accordance with an amount of a plurality of the liquid material applicator at the prescribed location, wherein the pressing portion of the click member has an area that can simultaneously press rear ends of the plurality of the liquid material applicators, and wherein clicking the click member to move the pressing portion between the first position and the second position makes it possible to simultaneously engage and disengage the plurality of the liquid material applicators.

8. The method of drawing according to claim 6, the drawing device further comprising:

a drawing unit including a drawing head that uses the liquid material applicator to draw on the surface of the nail, and an inkjet that draws by printing on the surface of the nail, wherein when the inkjet is printing on the surface of the nail, the liquid material applicator is arranged at a first position with the outer peripheral surface of the tip side of the liquid material applicator contacting the edge of the opening in the inner cap.

9. A method of drawing using a drawing device, comprising:

preparing the drawing device, which includes a liquid material applicator that applies a liquid material to at least one portion of a surface of a nail; and a cap that covers a tip side of the liquid material applicator, said cap including: an inner cap that has an opening and, when an edge of the opening in said inner cap contacts an outer peripheral surface of the tip side of the liquid material applicator, the inner cap houses at least one portion of the tip side of the liquid material applicator; an outer cap that has an opening and that is arranged outside of the inner cap and, when said at least one portion of the tip side of the liquid material applicator is housed in the inner cap, the outer cap houses a region that includes said at least one portion of the tip side of the liquid material applicator that is housed by the inner cap; and an elastic member that is arranged between the outer cap and the inner cap and that applies force to the inner cap towards the opening in the outer cap;

contacting the outer peripheral surface of the tip side of the liquid material applicator to the edge of the opening of the inner cap when the liquid material applicator is not applying the liquid material on the surface of the nail; and locking the liquid material applicator to the outer cap via a pressing force that is greater than a pressing force of a contact state with the outer peripheral surface of the tip side of the liquid material applicator and that opposes a force of the elastic member, said pressing force being applied through the liquid material applicator to the edge of the opening in the inner cap, thereby causing the locking mechanism of the liquid material applicator and the outer cap to lock the liquid material applicator and the outer cap together, wherein the locking mechanism is constituted by a threaded structure disposed between the outer peripheral surface of the tip side of the liquid material applicator and the inner peripheral surface of the outer cap.

10. The method of drawing according to claim 9, wherein the cap is provided in a plurality in accordance with an amount of a plurality of the liquid material applicator at the prescribed location, wherein the pressing portion of the click member has an area that can simultaneously press rear ends of the plurality of the liquid material applicators, and wherein clicking the click member to move the pressing portion between the first position and the second position makes it possible to simultaneously engage and disengage the plurality of the liquid material applicators.

11. The method of drawing according to claim 9, the drawing device further comprising:

a drawing unit including a drawing head that uses the liquid material applicator to draw on the surface of the nail, and an inkjet that draws by printing on the surface of the nail, wherein when the inkjet is printing on the surface of the nail, the liquid material applicator is arranged at a first position with the outer peripheral surface of the tip side of the liquid material applicator contacting the edge of the opening in the inner cap.

* * * * *